US006799658B2

(12) United States Patent
Cogar et al.

(10) Patent No.: US 6,799,658 B2
(45) Date of Patent: Oct. 5, 2004

(54) MOBILE OUTRIGGER SCAFFOLDING SYSTEM

(75) Inventors: Terry W. Cogar, Prince Frederick, MD (US); Brooke Schumm, III, Ellicott City, MD (US)

(73) Assignee: Terry L. Cogar, Huntingtown, MD (US)

( * ) Notice: Subject to any disclaimer, the term of this patent is extended or adjusted under 35 U.S.C. 154(b) by 55 days.

(21) Appl. No.: 09/747,648

(22) Filed: Dec. 26, 2000

(65) Prior Publication Data

US 2002/0166722 A1 Nov. 14, 2002

Related U.S. Application Data

(60) Provisional application No. 60/173,408, filed on Dec. 28, 1999.

(51) Int. Cl.[7] ..... E04G 3/00; E04G 3/10

(52) U.S. Cl. ..... 182/82; 182/150; 248/228.6; 248/218.4

(58) Field of Search ..... 182/12, 82, 150, 182/222, 121; 52/36.4, 36.5; 248/218.4, 219.1, 219.3, 228.6, 238; 256/65

(56) References Cited

U.S. PATENT DOCUMENTS

| | | | | |
|---|---|---|---|---|
| 3,011,587 A | * | 12/1961 | Mallog | 182/150 |
| 3,120,878 A | * | 2/1964 | Neeley | 182/82 |
| 3,660,871 A | * | 5/1972 | Boyle, Jr. | 248/221 X |
| 3,844,520 A | * | 10/1974 | Werner et al. | 248/228.6 X |
| 4,472,090 A | * | 9/1984 | Krings | 248/228.6 X |
| 4,781,348 A | * | 11/1988 | Cutforth et al. | 248/218.4 |
| 5,156,235 A | * | 10/1992 | Preston | 182/82 X |
| 6,098,942 A | * | 8/2000 | Heath | 248/228.6 |
| 6,302,238 B1 | * | 10/2001 | Preusser et al. | 182/150 |

FOREIGN PATENT DOCUMENTS

| | | | | |
|---|---|---|---|---|
| GB | 2100115 | * | 12/1982 | 248/218.4 |
| JP | 6136932 A | * | 5/1994 | 182/150 |

OTHER PUBLICATIONS

Lynn Ladder and Scaffolding Co. P.O. 346, 220 S. Common St.West Lynn, MA 01905 Catalog 97 used in 1999–2000 p pp. 32,43,36,38,46–49,68,74 and info. order page, no month available.

Atlantic Scaffolding Company, Washington, DC (202) 779 – 1390, Skyclimber Total Powered Scaffolding Systems 4 pages from brochure not numbered, 199 order edition (address, 3 N. Central Ave., Baltimore, MD 21202), no date & month available.

WACO (Reg. TM) Wedgelok (Reg. TM Pat. 4,549.634, 5 pages from catalog, WACO Internatioal 4545 Spring Rd., Cleveland, OH 44131catalog for use in 1999, no month available.

(List continued on next page.)

*Primary Examiner*—Hugh B. Thompson, II
(74) *Attorney, Agent, or Firm*—Brooke Schumm, III; Daneker, McIntire Schumm et al.

(57) ABSTRACT

Specially designed plates and/or mounting apparatus against and on the standard vertical column used in construction of office structures or other structures including bridges. Each set of plates has a clamping mechanism design to fit around or on the vertical column and has protrusions onto which are mounted a bracket with holes fitting on the protrusions. The brackets project outside the skin of a building and deck planks or pics can be mounted on the brackets to allow workmen to safely walk and work on the deck planks to perform work on a floor-by-floor basis. The system can be dissembled quickly and moved to another part of the same floor, to a new floor, and can be used around the outside corner of a structure or from an overhang or from a horizontal beam. The system can be used with steel tube construction with or without fireproofing.

14 Claims, 11 Drawing Sheets

OTHER PUBLICATIONS

Safway Steel Products Inc. N 14 W23833 Stone Ridge Dr.. Suite 400, Waukesha, WI 53188, selections from 1996, no month available.
Copyright catalogfor Tube & Clamp Scaffolding, (4 pages)
Modular Work Platform selection with cover page (3 pages) putlogs, 9 pages, Adjust–A–Shore Heavy Duty Shoringpp. 1–10, Pwer Swing Systems, pp. 4, 5, 8–11, (Copyrt. 1993; Systems Scaffolding pp. 8–14, Sectional Scaffolding, pp. 1, 2–5, 8,9,17, plus two unnumbered pages. (last two copyrt. 1996, no month available.

* cited by examiner

MOBILE OUTRIGGER SCAFFOLDING SYSTEM

This invention is a continuation-in-part of Provisional Application No. 60/173,408 filed on Dec. 28, 1999 by inventor Terry W. Cogar entitled "A Mobile Outrigger Scaffolding System," and of a Provisional Application filed on Dec. 26, 2000 also called a Mobile Outrigger Scaffolding System as to which a serial number has not yet been assigned.

FIELD OF INVENTION

This invention primarily relates to the construction industry, especially to buildings that have a structural skeleton with floors, after which phase of construction exterior surface and windows are added. Present technology necessitates the building of scaffolding on the exterior of the structure, often from the ground up. The present invention creates a mobile system mounted on the structural skeleton that furnishes outriggers exterior to the floor and proposed skin of the building, upon which deck planks can be placed, enabling workers to quickly and efficiently access the exterior of the building with construction material, mount or apply the material, and then dismantle the mobile outrigger system and move to a different location on the building. The system is flexible in design to allow work around the exterior corner or edge of a building, or from a horizontal overhang or beam. Once the deck planks and rails are in place, the worker has no need to climb up traditional scaffolding to reach the desired level. The stability and access to the mobile outrigger scaffold in inclement weather or adverse ground conditions is significantly better than traditional ground-up scaffolding and lessens environmental impact adjacent to the structure.

BACKGROUND OF INVENTION

The prior art of most note is well-known and involves the preparation of ground-up scaffolding. Such scaffolding requires a stable surface, and if built from the ground-up, requires access from the ground which is inconvenient in inclement weather conditions. If mounted up the side of a building, substantial effort requiring ample time to assemble and dissemble, and normally requiring welding, is required if scaffolding is to be based from a floor or stage above ground level.

The assembly of scaffolding itself has risks to workers from failure or falling objects from higher levels of scaffolding. The present invention minimizes any risk in assembly of the mobile outrigger scaffold to the building because a worker is not outside of the building. The setting of deck planks on the outrigger brackets requires attention to safety, but once the deck planks and rails are in place, the worker has no need to climb up scaffolding to reach the desired level. The stability and access to the mobile outrigger scaffold in inclement weather or adverse ground conditions is significantly better than traditional ground-up scaffolding and lessens environmental impact adjacent to the structure.

DESCRIPTION OF FIGURES

FIG. 2B shows an H-beam with the center section parallel to the proposed curtain wall of a building. FIG. 2C shows an H-beam with the center section parallel to the proposed curtain wall of a building. FIG. 2D focuses on the corner and the relative change in orientation of the center section and edges of the vertical H-beams relative to the proposed curtain wall of a building.

DESCRIPTION OF INVENTION

Figure 1A:
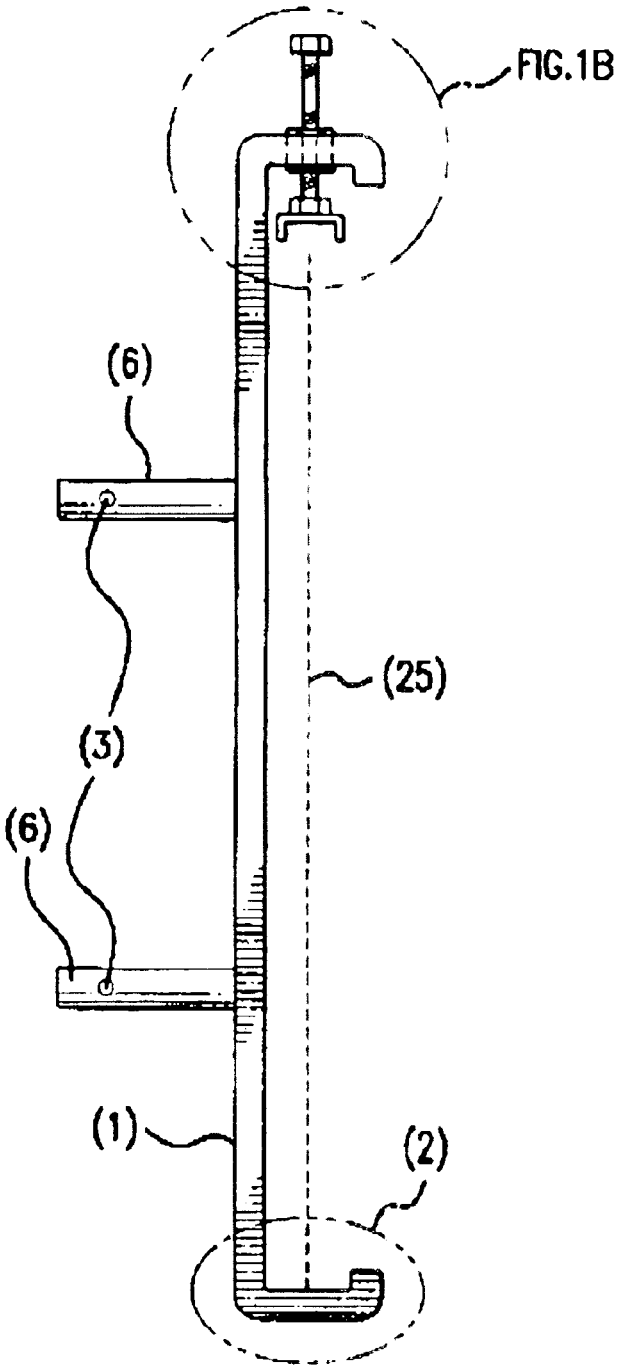
FIG. 1 shows a basic flat support plate with ends shaped like C-folds and a clamping mechanism, with detail of the clamping mechanism.
Figure 1B:
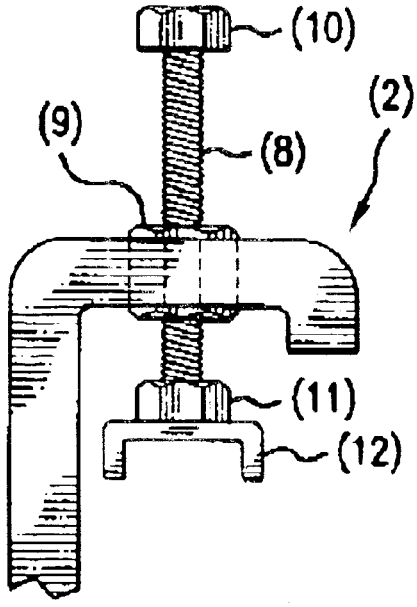
Figure 2A:
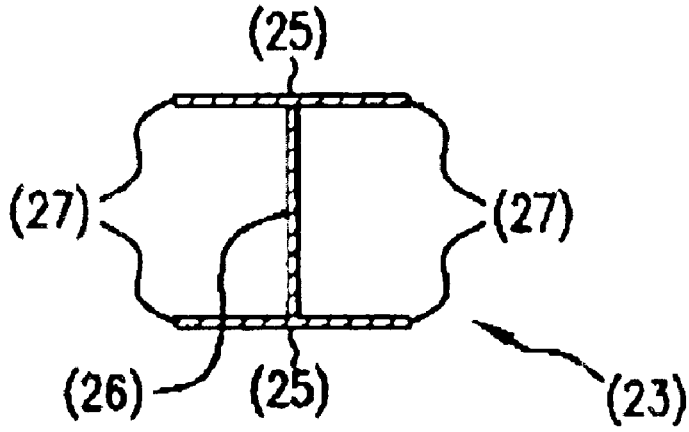
FIG. 2A shows a sample H-beam with identification of the terms used relative to an H-beam in this invention, and the top view of an illustration of a proposed building curtain wall and the typical arrangement of vertical structural H-beams.
Figure 2:
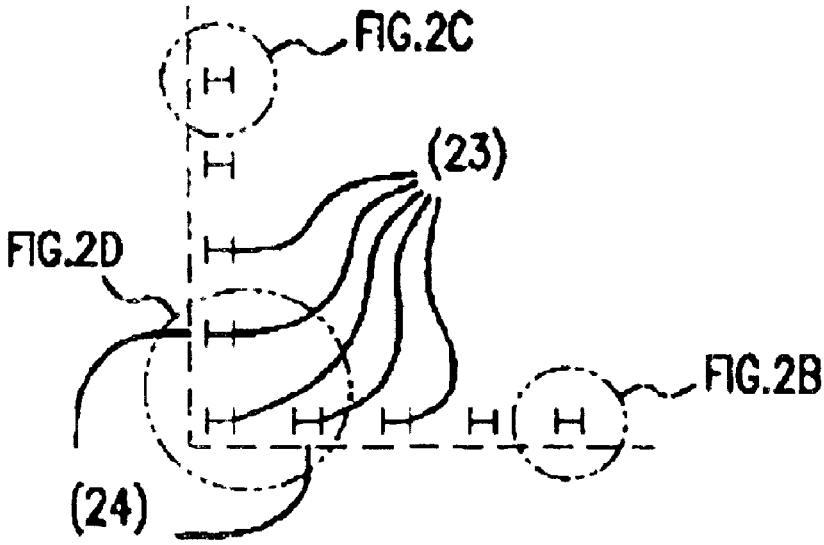
FIG. 2 has four sub-figures.

The essence of one preferred mode of the invention begins primarily for vertical column structures with a flat plate that has ends shaped like C-folds on the shorter edges of the plates, as opposed to the longer edges, as in FIG. 1. A line perpendicular to the longer edges will be oriented vertically. A line perpendicular to the shorter edges of the plates will be oriented horizontally and will be a horizontal axis. The plate may be formed, cast or forged. A typical plate would have shorter edges 6–8 inches long. A typical H-beam is 9 inches wide on the end face of a vertical H-beam.

Figure 5:
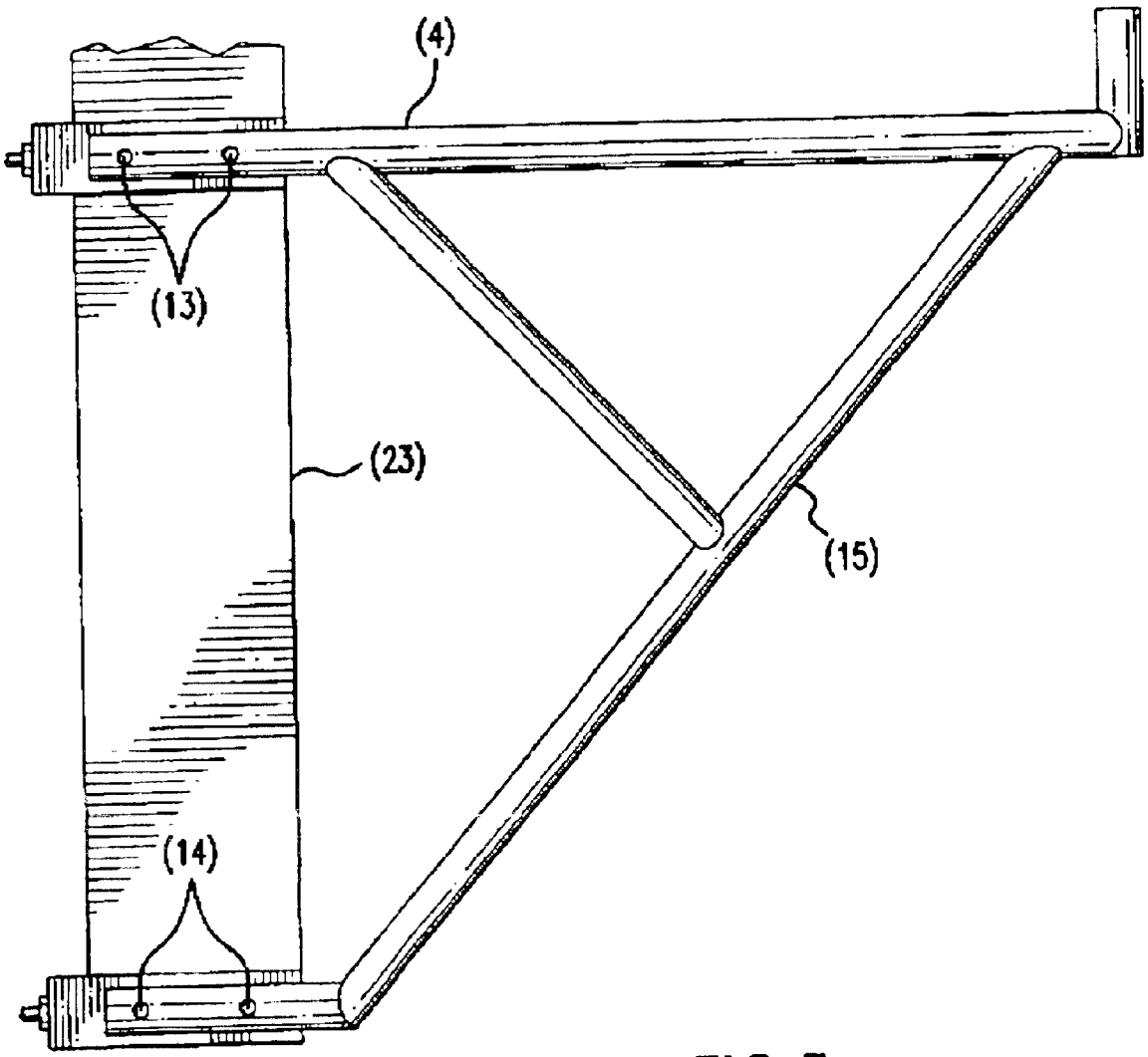
FIG. 5 shows a side view of a mobile outrigger scaffold installed on an H-beam awaiting a deck plank.

This preferred mode of the invention uses the edges of a vertical column in the shape of an H-beam standing on end as shown in FIGS. 2A–2D. The ends of the flat plate are shaped like a C-fold which C-fold has an inside perimeter which can fit around the edge of a vertical column H-beam. The distance between C-folds should be sufficient so that when one C-fold is situated on one edge of a face of an H-beam, the other C-fold with a clamping mechanism inside can be situated around the opposite edge. Inside at least one of the C-folds is a clamping mechanism, normally consisting of a metal piece, which could have an indentation in it and would be driven by a screw mounted through the C-fold. The clamping mechanism can be a nut welded to a screw to grip with a wrench, which screw passes through a nut welded or embedded in the C-fold through which the screw passes to a mechanism with a rotationally flexible or weaker end so the screw can put pressure on a clamp face applied to the edge of an H-beam. A levered clamping mechanism could also be employed to direct force against a beam and pull the opposite C-fold securely against the vertical H-beam as shown in FIGS. 1 and 5.

When the plate is set facing on the vertical H-beam with the C-fold edges cupped around cupped around the end face of the vertical H-beam, the clamping mechanism is tightened, and one C-fold is pulled more tightly into the beam while the C- fold with the clamping mechanism grips the opposite side resulting in a firmly mounted plate on the vertical H-beam.

From this basic plate design, the best mode of the invention works in two parallel ways. In the first mode, if the center section of a vertical H-beam is basically parallel to the proposed outer curtain wall of a building, the best mode is the use of a plate with perpendicular cylindrical protrusions supporting a bracket as in FIGS. 1 and 5. In the second mode, if the center section of a vertical H-beam is basically perpendicular to the proposed outer curtain wall of a building, then the best mode is the use of three plates also referred to as a triad of plates.

For proceeding around the corner of a building, assuming for the moment the center sections of all vertical H-beams are oriented in the same direction, then a combination of the first and second modes is appropriate.

Figure 7:
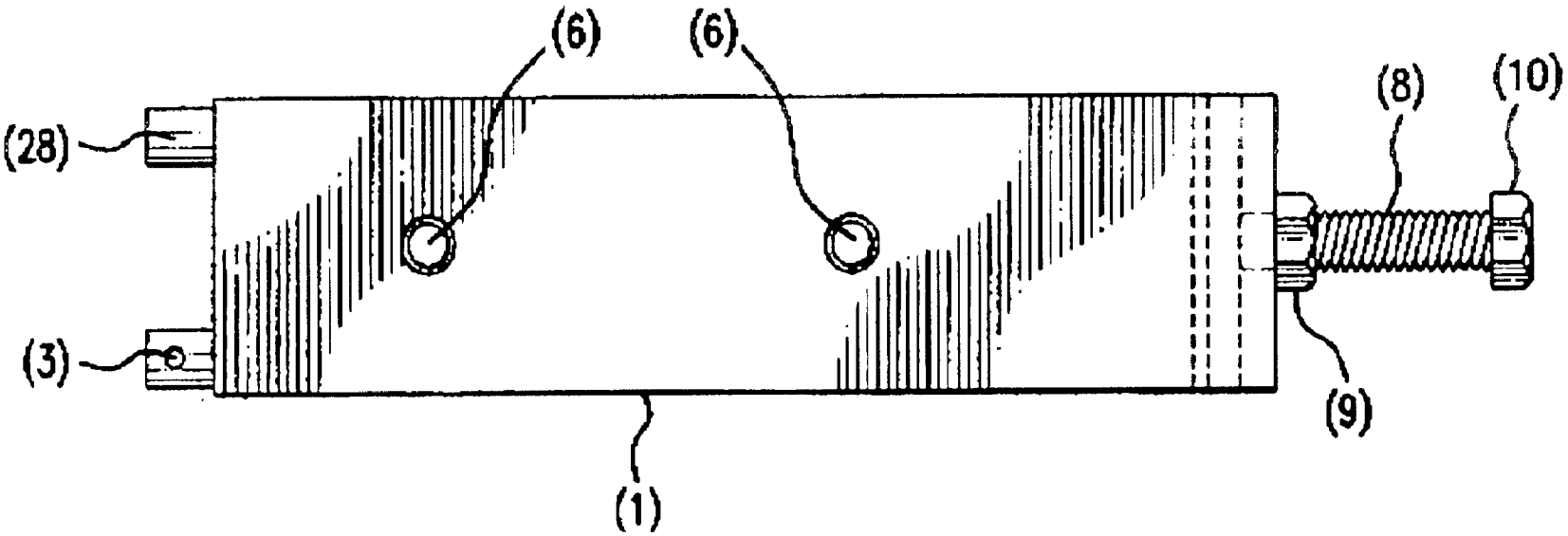
FIG. 7 shows a side view of the plate in FIG. 6.

The basic support plate for the first mode has on it two cylindrical protrusions which will be opposite the side of the plate placed against the H-beam as shown in simplest form in FIG. 1 and more complex from in FIG. 7. These cylindrical protrusions may be smooth protrusions to facilitate a support bracket or deck bracket being slid on the protrusions. Normally, a retaining pin on the protrusion would prevent the support from sliding off. Alternatively, the protrusion could be a bolt. Normally, a retaining pin or a nut on the protrusion that is a bolt would prevent the support from sliding off. Ridges or notches could be used to prevent the support from sliding off.

One of these support plates mounted on an H-beam then has a horizontal bar with holes in it mounted so the horizontal bracket protrudes out from the plate mounted on the H-beam. The horizontal bracket is then exterior of a proposed outer curtain wall of a building. The bracket can have a deck plank placed on it and functions as a walkable deck in combination with another plate on the next H-beam over in a building. Similarly, two plates, over and under, with one protrusion could be used. However, for safety reasons, it is preferable to use two plates on each H-beam, each with two perpendicular protrusions and use a bracket type of support on each set of two plates on each H-beam. A bracket type of support could be an upper horizontal bar with holes for the cylindrical protrusions on the interior end of the upper horizontal bar with a lower angle bar with a horizontal end having holes underneath the upper horizontal bar holes, with the angle bar supporting the outside end of the upper horizontal bar. This can also be referred to as a deck support. Further bracing can be put on the bracket type of support. The horizontal bar or the bracket type of support would normally have an upturned end to prevent a deck plank from inadvertently sliding off which upturned end is opposite the end with the holes to mount the bracket type of support on the protrusions on the plate as seen in FIG. 5. Two sets of two plates with bracket type of supports on adjacent vertical H-beams, and a deck plank placed on them, and a restraint on the protrusions provide a stable, mobile outrigger scaffold with deck plank which permits access to the exterior of a building to conduct activities on the outside of the building such as installing curtain wall, windows, painting and the like as seen in side view of a mounted bracket in FIG. 5.

Figure 3:
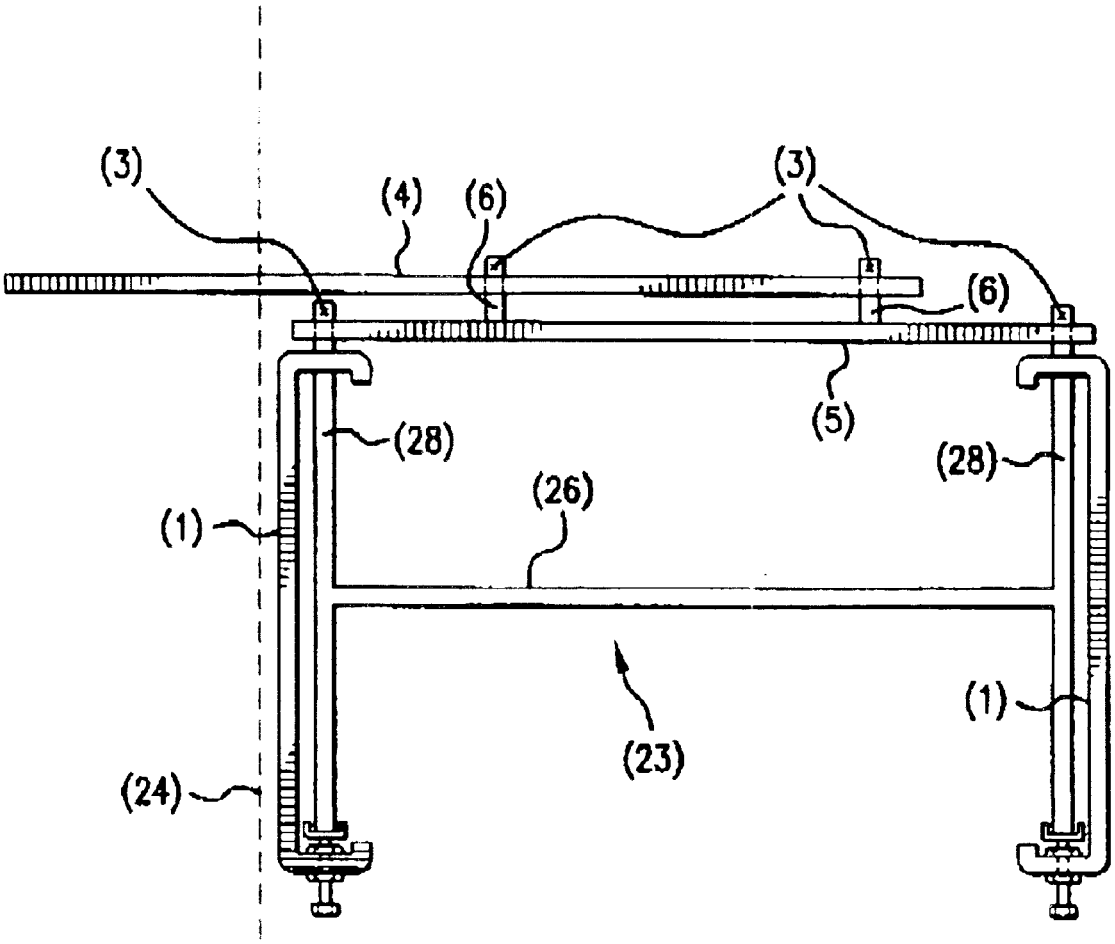
FIG. 3 is a top view of the disposition of the invention relative to a building and vertical H-beam shown in FIG. 2C.

The invention recognizes that not all vertical H-beams will be oriented with the center section parallel to the curtain wall. For vertical H-beams with the center section generally perpendicular to the curtain wall, the second mode and a set of three plates using a plate somewhat like the first plate and a modified set of two other plates is used as illustrated in FIG. 3.

In the second mode, again starting with the basic plate design, a support plate is used. This plate has cylindrical protrusions mounted on one end parallel to the horizontal axis which will be called support protrusions. These protrude from the edge of the plate adjacent to the C-folds. The support protrusions are thus parallel to the flat surface of the plate. When the plate having the C-fold shaped ends is mounted on the vertical H-beam with the center section perpendicular to the curtain wall, the support protrusions run parallel to the proposed curtain wall. A first support plate is mounted on the outside face of such a vertical H-beam, and a second support plate is mounted on the inside face of such a vertical H-beam, by tightening the clamping mechanisms.

Figure 4:
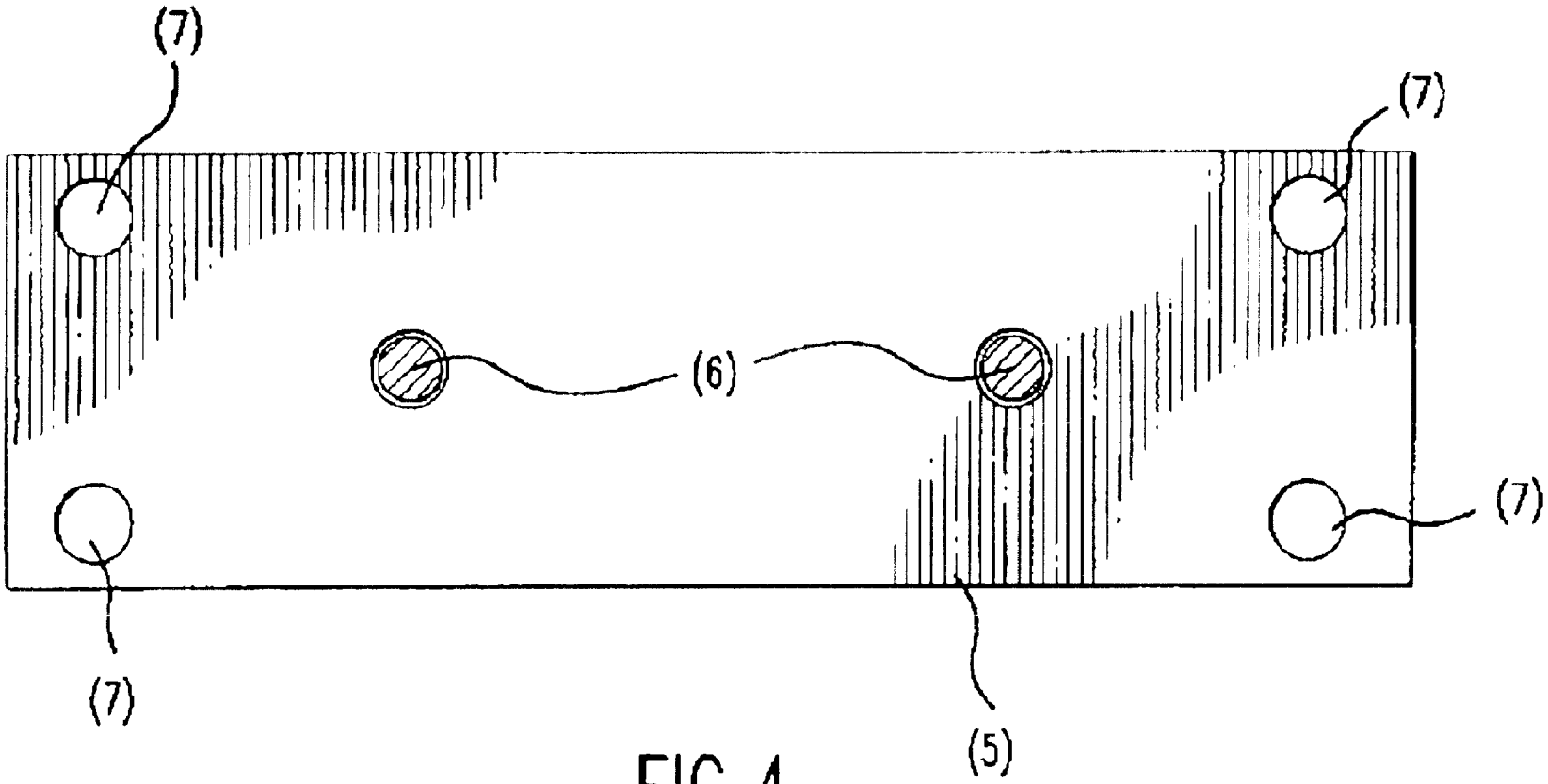
FIG. 4 shows further detail of a basic bracket plate.

For the second mode, a third support plate, also referred to as a bracket plate, as shown in FIG. 4, is made with apertures in it adjacent to the short edges of the plate to accommodate the support protrusions of the first and second plates. This third support plate would normally not need to have C-folds or a clamping mechanism. The third support plate would have cylindrical protrusions perpendicular to the flat surface of the plate.

Figure 6:
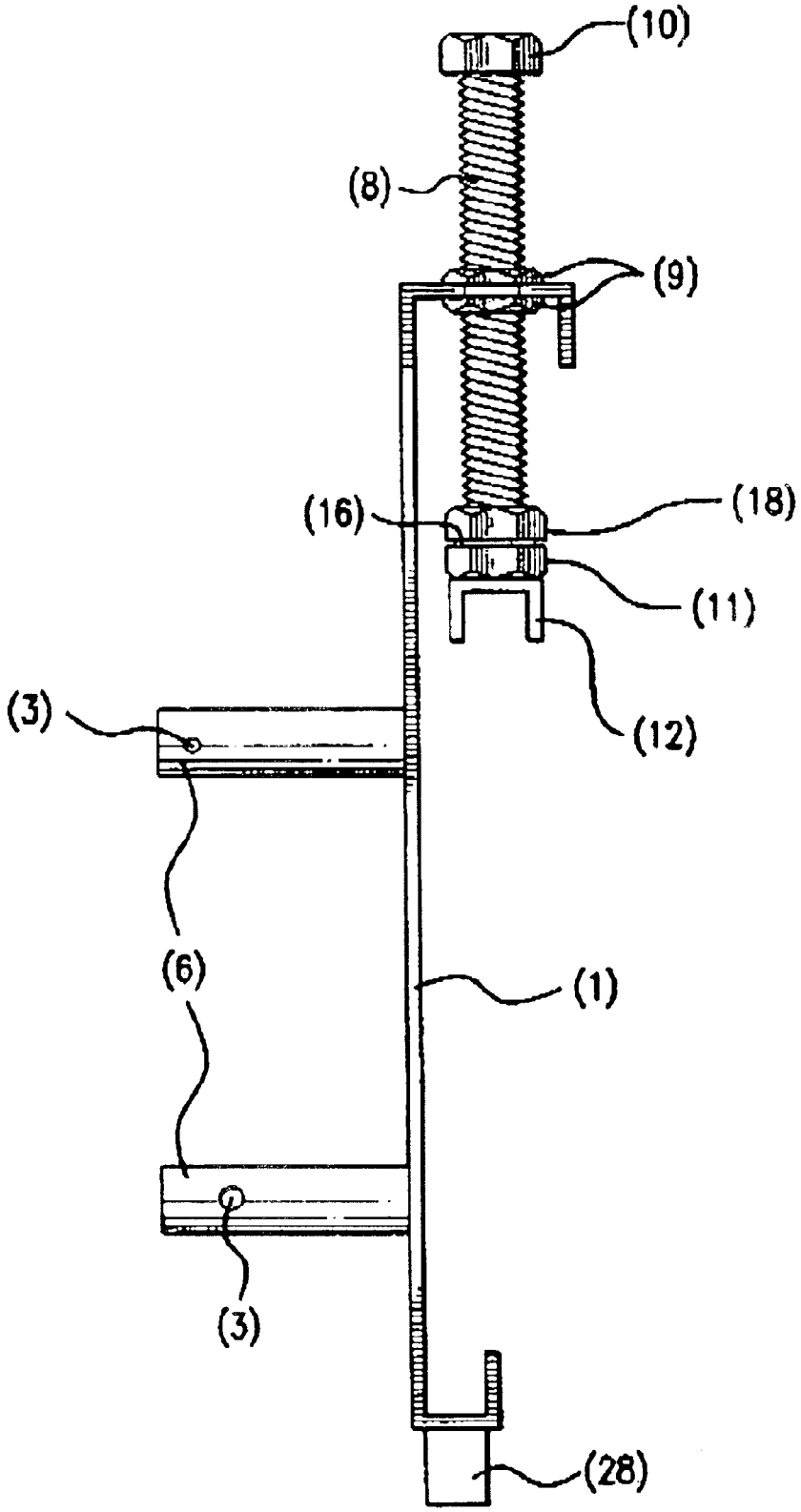
FIG. 6 shows a top view of a flat plate to be disposed adjacent and parallel to the face of an I beam which plate can be used for either a support plate in the mode of the invention set on H-beams with the center section parallel to the proposed curtain wall of a building or as a support plate for a bracket plate in the mode of the invention set on H-beams with the center section perpendicular to the proposed curtain wall of a building.

The support protrusions of the first and second plates are shown in top view in FIG. 6 and side view in FIG. 7; if the first and second plates have cylindrical protrusions perpendicular to the flat surface of the plate, as in FIGS. 6 and 7, the plate is more versatile and can be used as the plate in the first mode of the invention, and the deck bracket mounted on the cylindrical protrusions.

By placing the first of these three plates on the face of the vertical H-beam, and mounting it as before, and placing the second plate on the opposite face of the vertical H-beam, and mounting it as before, and placing the third support plate on the support protrusions, the concave portion of the vertical H-beam is spanned by the third support plate, and protrusions exterior to the outline of the vertical H-beam are presented and available on which to mount the bracket type of support which will protrude outside the curtain wall. FIG. 3 illustrates this mounting. Again, the invention can be revised so there is only one support protrusion to hold a third support plate and two protrusions from the side opposite the flat side of the plate, but for safety's sake, normally an upper set of three plates, and a lower set of three plates would be used on each vertical H-beam, and a second upper and lower set on an adjacent vertical H-beam. The bracket type of support or deck bracket is mounted on the upper and lower set of plates on each adjacent vertical H-beam, and restraints are placed on the cylindrical protrusions to prevent the bracket type of support from inadvertently coming off. With a deck plank placed on the bracket type of support, a stable, mobile outrigger scaffold with deck plank permits access to the exterior of a building to conduct activities on the outside of the building such as installing curtain wall, windows, painting and the like.

A further distinct advantage is obtained by the set of plates from the first mode of the invention and two triads of plates from the second mode of the invention. At the corner of a building, using the corner vertical H-beam, and two adjacent vertical H-beams (all three H-beams with the center section facing the same way as in FIG. 2D), a first set of triad plates is mounted on the adjacent vertical H-beam having a center section perpendicular to the proposed curtain wall. The second triad is mounted on the exterior two sides of the corner vertical H-beam, and on the third side toward the just-referenced one of the two adjacent vertical H-beams. With the first mode of invention mounted on the remaining adjacent vertical H-beam having a center section parallel to the proposed curtain wall, and lower identical set of plate(s) placed on each vertical H-beam, and brackets set on the cylindrical protrusions as shown in FIGS. 3 and 5, deck planks set on the brackets enable access exterior to the building and around the corner to conduct activities on the outside of the building.

In addition, the invention is easily dissembled or assembled by a single person, can be carried by a single person, and moved around a floor, or from floor to floor as construction progresses. Normally the setting of the deck plank would require two sets of hands, but by sliding it onto one bracket, and then lifting the opposite end onto an adjacent bracket, one person can set the deck plank. Alternatively the deck plank can be slid onto an adjacent bracket from an already mounted deck plank.

Figure 8:
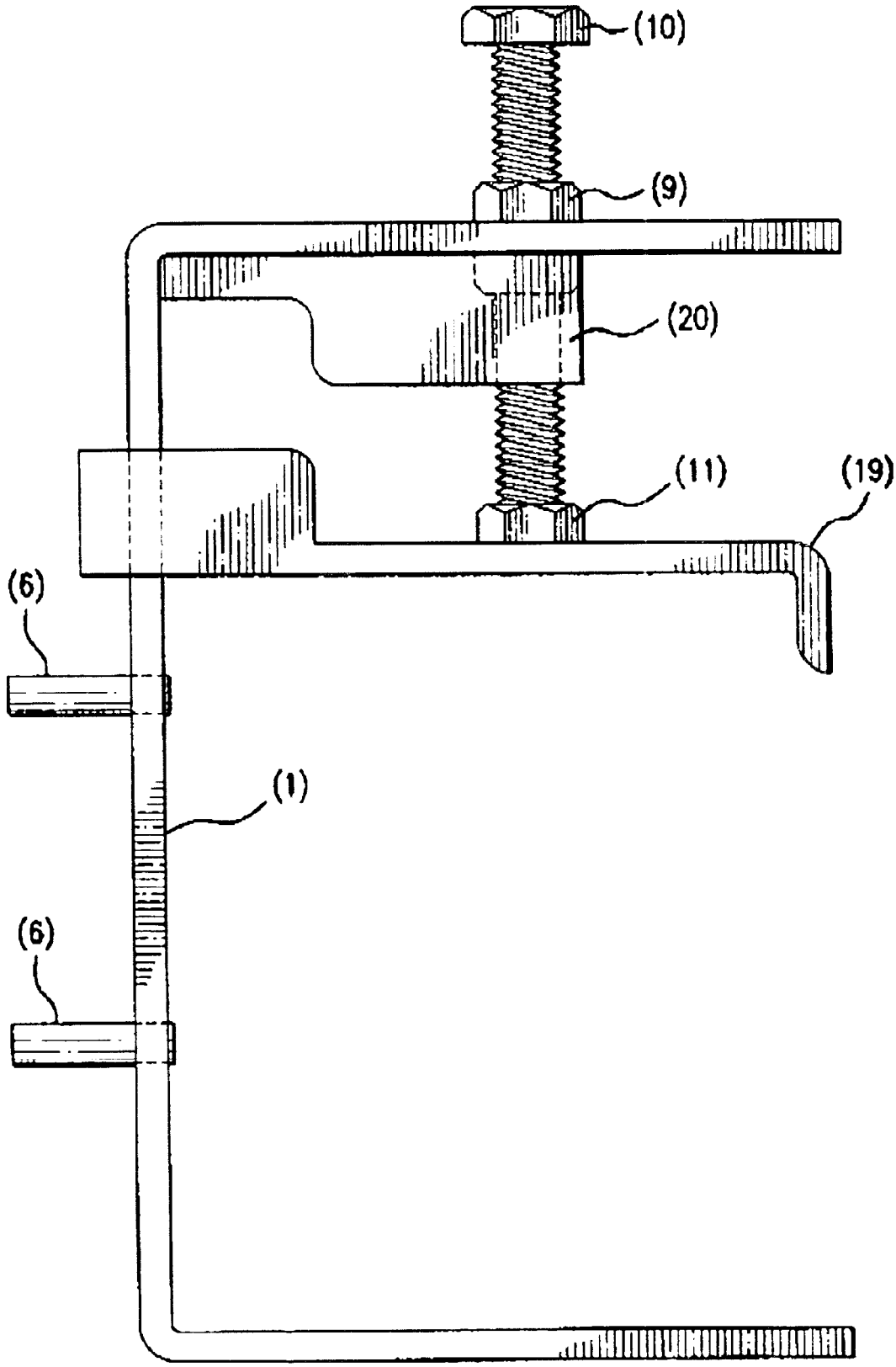
FIG. 8 shows an L-fold mechanism mountable on a vertical steel tube column.

A third preferred mode of the invention uses the same principles as the just-described mode, but proposes that the flat plate that have ends shaped like L-folds on the shorter edges of the plates, as opposed to the longer edges, as in FIG. 8. A line perpendicular to the longer edges will be oriented vertically. A line perpendicular to the shorter edges of the plates will be oriented horizontally and will be a horizontal axis. The plate may be formed, cast or forged. This mode has the special utility of being able to be mounted on vertical columns without an H-shape, i.e., vertical columns that are square or rectangular. Another modern construction method is to use square steel tubes and face them with fireproofing. After the skeleton of a building has been built, and the floor base structure is in place, and even after fireproofing, the invention, by stripping a foot or so of the (usually blown-on) fireproofing, can be mounted temporarily on a vertical column. The pressures are such that the invention, once mounted by the tightening of the clamping mechanism, mounted through the L-fold, remains securely on the column and functions as the first and second modes. The remaining plates of the invention are mounted as before and the cylindrical and support protrusions are mounted as in the earlier modes. Again, the clamping mechanism can be a nut welded to a screw to grip with a wrench, which screw passes through a nut welded or embedded in the L-fold through which the screw passes and a mechanism with a rotationally flexible or weaker end so the screw can put pressure on a clamp face applied to the edge of a steel tube. With the plates of the invention as before and the cylindrical and support protrusions as before, the L-fold design referred to in this paragraph is equally useful around the corner of a building built with square or rectangular vertical steel tube columns.

A fourth preferred mode of the invention combines the characteristics of the earlier modes. In this mode, a C-fold plate is designed that a flat plate that has ends shaped like C-folds on the shorter edges of the plates, as opposed to the longer edges, as in FIGS. 1 and 9. A line perpendicular to the longer edges will be oriented vertically. A line perpendicular to the shorter edges of the plates, and parallel will be oriented horizontally and will be a horizontal axis. The horizontal axis will run from what is normally viewed as the front to the back of the vertical steel tube structural column, and the front C-fold to the back C-fold of the invention. The plate may be formed, cast or forged. A typical plate would have shorter edges 6–8 inches long. A typical H-beam is 9 inches wide on the end face of a vertical H-beam.

Figure 9:
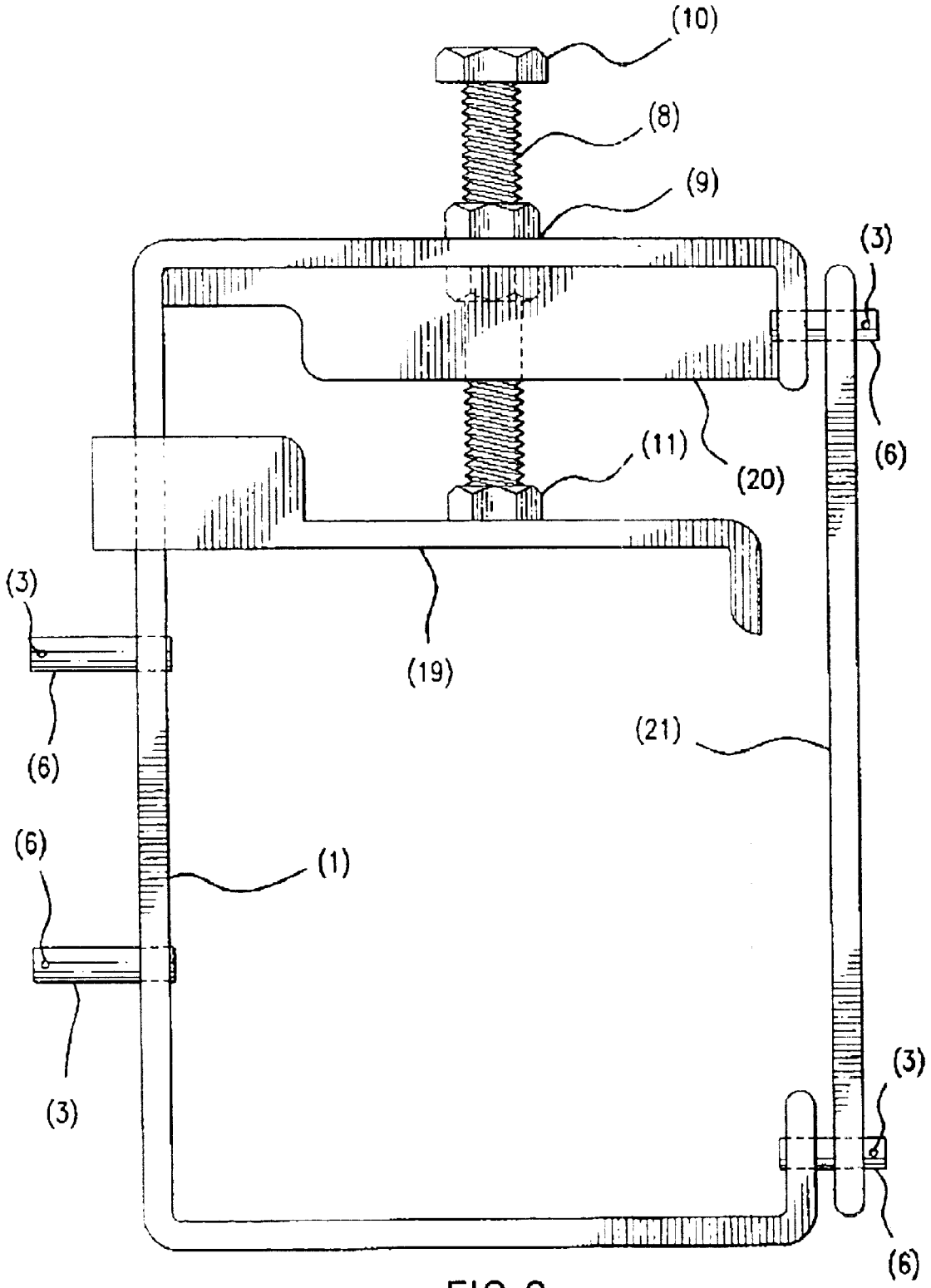
FIG. 9 shows a C-fold mechanism which C-fold has an interior portion that is sufficiently large to encompass a face of a vertical steel tube column.
Figure 10A:
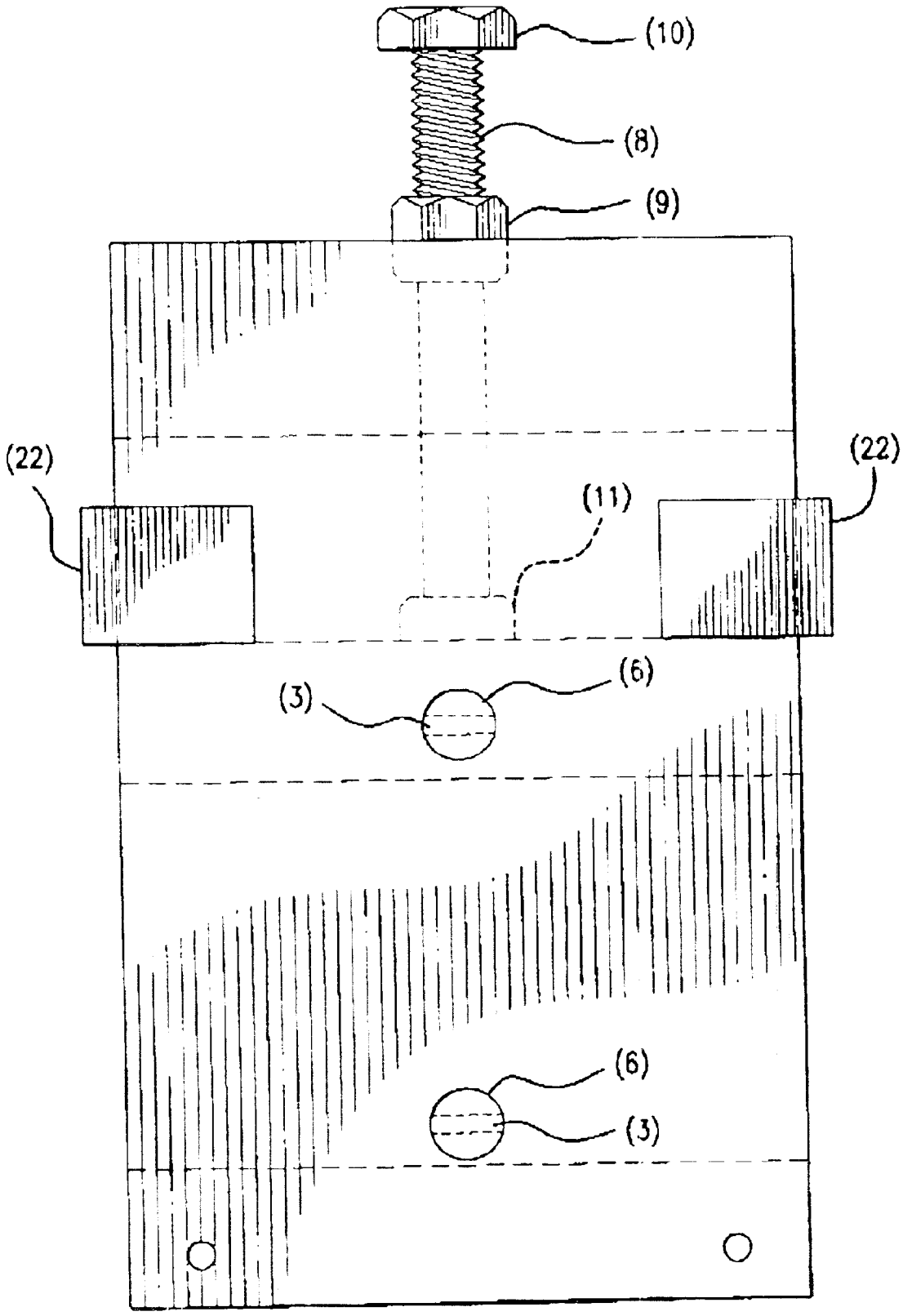
FIG. 10A shows a side view as mounted on a beam (beam not shown) with a safety plate mounted on the invention, and shows an additional set of cylindrical protrusions which can be mounted on the safety plate.
Figure 10B:
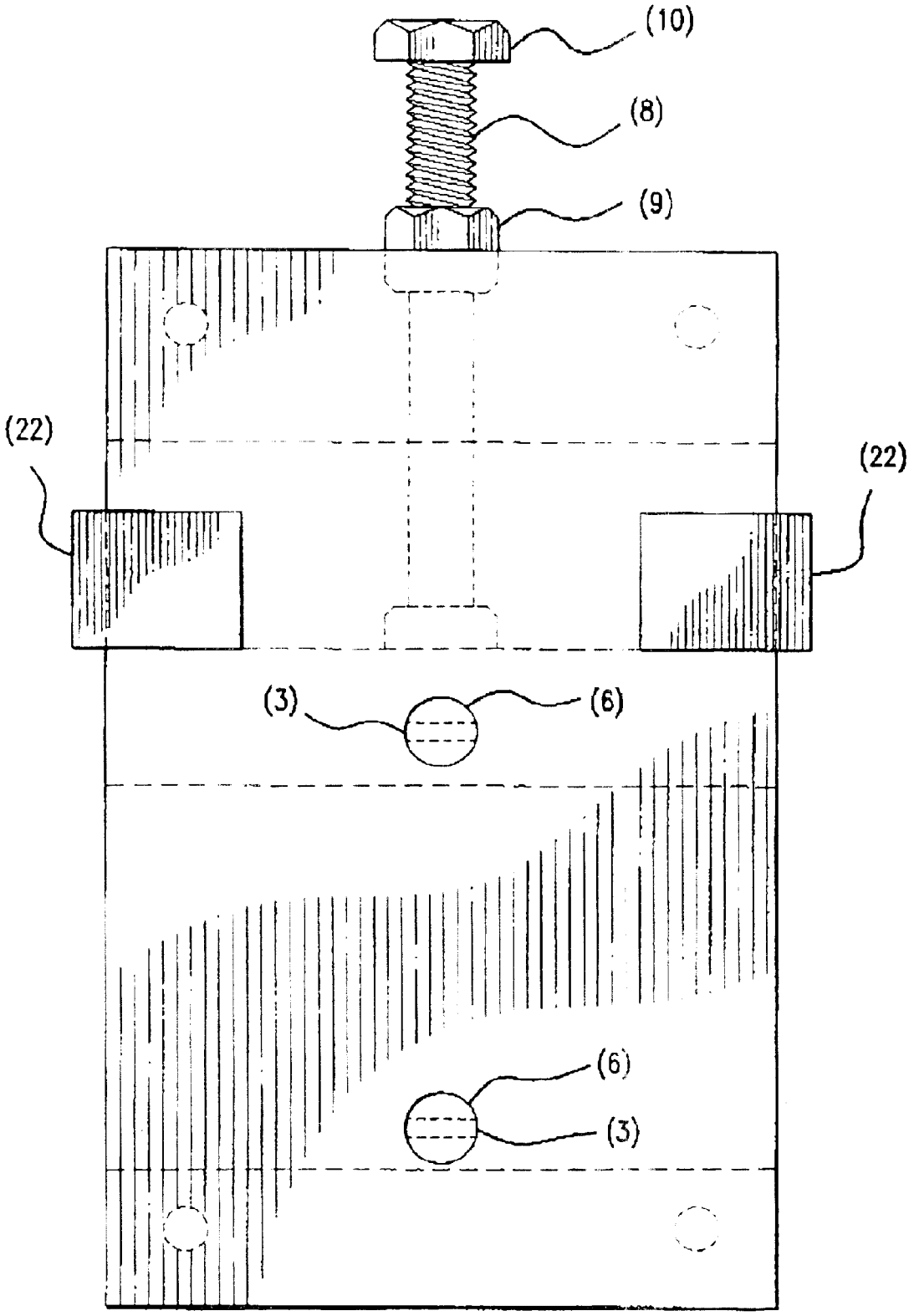
FIG. 10B shows the opposite side the interior of which side is referred to in the description as the flat side. The pins for the safety plate are shown as hidden.

This preferred mode of the invention uses the entire square or rectangular vertical steel tube column standing on end as in FIG. 9, either in steel tube form or as an H-beam, but more often in vertical steel tube construction. The ends of the flat plate are shaped like a C-fold which C-fold has an inside perimeter which can fit around the face of the steel tube vertical column. The distance between C-folds should be sufficient so that when one C-fold is situated on one face of a vertical steel tube column, the other C-fold with a clamping mechanism inside can be situated around the opposite face of the vertical steel tube.

A further modification of this mode is to reinforce the top and bottom of the C-fold on the end of the flat plate which has the clamping mechanism. The reinforcement is by a metal plate which is secured across the C-fold end of the flat plate, preferably on the top and bottom. The reinforcement limits flexing of the 90 degree angles in the C-fold. The flat plate is made long enough to accommodate within the edges of the C-fold, the vertical column, and the reinforcement metal plate. The clamping mechanism can be retreated to be within the box formed by the reinforcement metal plate, and the flat plate and the C-fold. The reinforcement can be used on other modes of the invention to reinforce a square "L-fold," or a C-fold.

Inside at least one of the C-folds is a clamping mechanism, normally consisting of a metal piece to spread the pressure of a clamping screw, which metal piece could have an indentation in it and would be driven by a screw mounted through the selected C-fold. The clamping mechanism can be a nut welded to a screw to grip with a wrench, which screw passes through a nut welded or embedded in the C-fold through which the screw passes. The clamping mechanism includes a mechanism with a rotationally flexible or weaker end so the screw can put pressure on a clamp face applied to the face of a vertical steel tube column. A levered clamping mechanism could also be employed to direct force against a column and pull the opposite C-fold securely against the vertical steel tube analogous to the apparatus as shown in FIGS. 1 and 5.

When the plate, is set facing on the vertical steel tube column with the C-fold edges cupped around the end face of the vertical steel tube column, the clamping mechanism is tightened, and one C-fold is pulled more tightly into the beam while the C-fold with the clamping mechanism grips the opposite side resulting in a firmly mounted plate on the vertical steel tube column.

In this latter fourth mode, mounted on the flat plate on the horizontal axis are perpendicular cylindrical protrusions, normally two. They support a bracket analogous to FIGS. 1 and 5. Alternatively, or in addition, but not as a matter of requirement, support cylindrical protrusions can be mounted on the C-folds (or L-folds) in a position which is perpendicular to the flat side and the horizontal axis and parallel to the folded face. A support plate, designed like the earlier referenced third support plate (also called a bracket plate), can be mounted on these horizontal support cylindrical protrusions either as or also as a safety plate to prevent the C-folds from spreading away from each other, or to support a bracket on a second set of protrusions. The safety plate is not required but furnishes at least a cosmetic security. In steel tube construction, the invention with cylindrical tube protrusions on the support plate or the flat plate with C-fold ends defining a first horizontal plane, and with a second set of cylindrical tube protrusions defining a second horizontal plane, is particularly useful for rapid around-the-corner mounting of deck planks. Note that with the design referenced in this paragraph for the fourth mode, the orientation of the steel tube column is immaterial as long as the C-folds will fit around one dimension of the structural column.

In the fourth mode, as before, the cylindrical protrusions may be smooth protrusions to facilitate a support bracket or deck bracket being slid on the protrusions. Normally, a retaining pin on the protrusion would prevent the support from sliding off. Alternatively, the protrusion could be a bolt. Normally, a retaining pin or a nut on the protrusion that is a bolt would prevent the support from sliding off. Ridges or notches could be used to prevent the support from sliding off. Ridges or notches can be used to prevent a deck plank or pic from sliding off the bracket.

Again, on the cylindrical protrusions which are on a horizontal axis, a horizontal bar with holes in it is mounted so the horizontal bracket protrudes out from the plate mounted on the vertical steel tube column. The horizontal bracket is then exterior of a proposed outer curtain wall of a building. The bracket can have a deck plank placed on it and functions as a walkable deck in combination with another plate on the next H-beam over in a building. Similarly, two plates, over and under, with one protrusion could be used. However, for safety reasons, it is preferable to use two plates on each vertical steel tube, each with two perpendicular protrusions and use a bracket type of support on each set of two plates on each of at least two vertical steel tube columns. A bracket type of support could be an upper horizontal bar with holes for the cylindrical protrusions on the interior end of the upper horizontal bar with a lower angle bar with a horizontal end having holes underneath the upper horizontal bar holes, with the angle bar supporting the outside end of the upper horizontal bar. This can also be referred to as a deck support. Further bracing can be put on the bracket type of support. The horizontal bar or the bracket type of support would normally have an upturned end opposite the end with the holes to mount the bracket type of support on the protrusions on the plate to prevent a deck plank from inadvertently sliding off as seen in FIG. 5. Two sets of two plates with bracket type of supports on adjacent vertical columns, and a deck plank placed on them, and a restraint on the protrusions provide a stable, mobile outrigger scaffold with deck plank which permits access to the exterior of a building to conduct activities on the outside of the building such as installing curtain wall, windows, painting and the like as seen in side view of a mounted bracket in FIG. 5.

Note that the support protrusions for the support plate are therefore mounted parallel to the portion of the invention which is the front vertical face of the C-fold perpendicular to the vertical face of the flat plate which is bent to form the C-fold. The support protrusions are at the end of the front vertical face parallel to the horizontal axis. The support protrusions are thus also parallel to the flat surface of the plate. When the plate having the C-fold shaped ends is mounted on the vertical column, normally the support protrusions run parallel to the proposed curtain wall.

Particularly in the third and fourth modes and their variations, by clamping the deck planks or pics to the support brackets for the deck planks, the invention can be used on circular columns. The clamping of the deck planks reduces any likelihood that the deck support brackets on adjacent columns could move toward or away from each other.

In each of the modes, the addition of an ear tab is suggested, which is a metal hook on the clamping mechanism which rides over the top edge of the flat plate. The tab is most easily welded. The inventors prefer a tab on top and another on the bottom of the clamping mechanism hooked under the bottom edge of the flat plate. In the third and fourth mode, the inventors prefer a small cut out in the metal reinforcement plate to accommodate the ear tab which cut out is located away from the fold being reinforced in the metal reinforcement plate adjacent to where it is attached to the flat plate.

The horizontal brackets can be used to suspend ropes to hold deck planks below them, or as suggested, motorized suspension cables, or ropes for rappellers doing painting or window washing. The invention may be used for supporting or establishing a deck plank on bridge columns to assist in painting or maintenance. By securing the deck plank to the bracket, the invention is functional even on circular columns.

In yet another mode, for mounting on or suspension from an overhang, or work from a horizontal structural member, or like work, the invention is equally useful with some modification. The plates as described may be used, but the cylindrical protrusions on which a bracket is mounted must be turned 90 degrees, so the bracket remains horizontal. Alternatively, the plates as described may be used, but the bracket must have a mounting arm which is 90 degrees to the horizontal bracket. Another variation on this alternative using the plates as described is to connect the top and bottom of the mounting bracket, place apertures for mounting the brackets on the now-vertical cylindrical protrusions, and thereby enable the portion of the bracket supporting a deck plank to be horizontal.

The claims, as more fully set forth in the claims, also cover the method of manufacturing the combination, and the method of employing the elements of the invention on a building.

The embodiments represented herein are only a few of the many embodiments and modifications that a practitioner reasonably skilled in the art could make or use. The invention is not limited to these embodiments nor to the versions encompassed in the figure which is intended as an aid to understanding the invention and is not meant to limit the disclosure or the claims. Alternative embodiments and modifications which would still be encompassed by the invention may be made by those skilled in the art, particularly in light of the foregoing teachings. Therefore, the following claims are intended to cover any alternative embodiments, modifications or equivalents which may be included within the spirit and scope of the invention as claimed.

We claim:

1. A mobile outrigger scaffold using at least two vertical structure members of a structure for floor-by-floor construction and maintenance of a structure without the necessity of ground-up scaffolding comprising:

a deck support bracket, being a horizontal bracket for deck support having a restraint end and a supporting end;

a rectangular support plate having a flat side to be placed against a vertical structural member of a structure, said vertical structure member having an exterior edge to toward the exterior of said structure and an interior edge toward the interior of said structure, said rectangular support plate being oriented from the interior edge to the exterior edge of such a vertical structural member;

said support plate having a vertical plate axis to be parallel to said plate and parallel to a vertical structural member against which said plate is to be placed;

said support plate having ends shaped in a C-fold parallel to said vertical plate axis;

said ends shaped in a C-fold having C-folds being sufficiently far apart so that said flat side of said plate having said ends shaped in C-folds can be placed against a vertical structural member with said C-folds of said ends facing said vertical structural member;

at least one of said ends shaped in a C-fold having a clamping mechanism exerting pressure interior to said end shaped in a C-fold to pull said other end shaped in a C-fold snugly against said vertical structural member;

said support plate having two cylindrical protrusions located opposite said flat side of said plate, protruding perpendicularly to said plate, and located on a line perpendicular to said vertical plate axis;

said supporting end of said deck support bracket having apertures to matingly receive said cylindrical protrusions;

at least one of said protrusions having a securing means to restrain said deck support bracket onto said at least one protrusion;

so that when two of said mobile outrigger scaffolds are received on adjacent structural members of a structure, and for each said mobile outrigger scaffold said clamping mechanism is tightened snugly and said deck support bracket is placed on said cylindrical protrusions of each said mobile outrigger scaffold, and when deck planks are placed on said deck support brackets, said mobile outrigger scaffolds permit movement of a user exterior to the vertical structural member of the structure on said deck planks.

2. The mobile outrigger scaffold according to claim 1, further comprising:

said deck support bracket having a restraint means at said restraint end to prevent deck planks from sliding over said restraint end.

3. A mobile outrigger scaffold using at least two vertical structure members of a structure for floor-by-floor construction and maintenance of a structure without the necessity of ground-up scaffolding, comprising:

a deck support bracket having a horizontal bracket and an angled support bracket said horizontal bracket having a restraint end and a supporting end;

said horizontal bracket having a restraint means at said restraint end to prevent deck planks from sliding over said restraint end;

said angled support bracket attached to said horizontal bracket proximate to said restraint end of said horizontal bracket;

said angled support bracket having a horizontally oriented end parallel to said supporting end of said horizontal bracket;

two rectangular support plates having a flat side to be placed against a vertical structural member of a structure, said vertical structure member having an exterior edge toward the exterior of said structure and an interior edge toward the interior of said structure, each said rectangular support plate being oriented from the interior edge to the exterior edge of such a vertical structural member, said support plates having a vertical plate axis to be parallel to said plate parallel to a vertical structural member against which said plate is to be placed;

said support plates having ends shaped in a C-fold parallel to said vertical plate axis;

one of said support plates being designated an upper support plate and the other of said support plates a lower support plate said ends shaped in a C-fold having C-folds being sufficiently far apart so that said flat side of said support plates having said ends shaped in C-folds can be placed against a vertical structural member with said C-folds of said ends facing said vertical structural member;

at least one of said ends shaped in a C-fold on at least one of said support plates having a clamping mechanism exerting pressure interior to said end shaped in a C-fold to pull said other end shaped in a C-fold of each said plate snugly against a said vertical structural member;

said support plates each having at least one cylindrical protrusion located opposite said flat side of said plate, protruding perpendicularly to said plate, and located on a line perpendicular to said vertical plate axis;

said supporting end of said horizontal bracket having apertures to matingly receive said at least one cylindrical protrusions of said upper plate;

said horizontally oriented end of said angled bracket having apertures to matingly receive said at least one cylindrical protrusions of said lower plate;

at least one of said at least one cylindrical protrusions on each said support plate having a securing means to restrain said horizontal bracket and said horizontally oriented racket onto said protrusion;

so that when two of said mobile outrigger scaffolds are received on adjacent structural members of a structure, and for each said mobile outrigger scaffold said upper and lower support plates are placed one above the other on a structural member of a structure, each said clamping mechanism is tightened snugly, and each said horizontal bracket is placed on each said upper support plate and each said horizontally oriented bracket is placed on each said lower support plate, and when deck planks are placed on said horizontal brackets, said mobile outrigger scaffolds permit movement of a user exterior to the vertical structural member of a structure on deck planks set on said horizontal brackets.

4. A mobile outrigger scaffold using at least two vertical structure members of a structure for floor-by-floor construction and maintenance of a structure without the necessity of ground-up scaffolding, comprising:

a deck support bracket being a horizontal bracket for deck support, having a restraint end and a supporting end;

said deck support bracket having a restraint means at said restraint end to prevent deck planks from sliding over said restraint end;

three rectangular plates having a flat side to be placed against a vertical structural member of a structure;

said plates having a vertical plate axis to be parallel to said plate and parallel to a vertical structural member against which said plate is to be placed;

two of said plates being support plates to be placed on a vertical structural member of a structure, said vertical structural member having an exterior face toward the exterior of said structure and an interior face toward the interior of said structure, one of said support plates to be placed adjacent to said interior face, and one of said support plates to be placed adjacent to said exterior face of the same vertical structural member;

said support plates having ends shaped in a C-fold parallel to said vertical plate axis;

said ends shaped in a C-fold having C-folds being sufficiently far apart so that said flat side of said plates having said ends shaped in C-folds can be placed against a vertical structural member with said C-folds of said ends facing said vertical structural member;

at least one of said ends shaped in a C-fold on each said support plate having a clamping mechanism exerting pressure interior to said end shaped in a C-fold to pull said other end shaped in a C-fold on each said plate snugly against said vertical structural member;

said two of said support plates each having at least one cylindrical plate holder protrusion projecting from each of said at least one of two ends shaped in a C-fold, said plate holder protrusions being perpendicular to said vertical plate axis, parallel to said flat side and perpendicular to said C-fold;

said third of said three plates being a bracket plate having a flat side to be oriented toward a vertical structural member of a structure and said flat side of said third plate having apertures to enable said bracket plate to matingly receive said cylindrical plate holder protrusions retaining said third of said three plates against each of said two said support plates when said support plates are placed on opposite sides of a vertical structure member and thereby enabling said bracket plate to be oriented from said interior face to said exterior face of such a vertical structural member;

at least one of said three plates, said at least one plate at least being said bracket plate, having two cylindrical support protrusions located opposite said flat side of said plate, protruding perpendicularly to said plate, and located on a line perpendicular to said vertical plate axis;

said supporting end of said horizontal bracket having apertures to matingly receive said cylindrical support protrusions;

at least one of said cylindrical plate holder protrusions on each said support plate having a securing means to restrain said bracket plate;

at least one of said cylindrical support protrusions having a securing means to restrain said horizontal bracket on to said at least one cylindrical support protrusions;

so that when two of said mobile outrigger scaffolds are received on adjacent structural members of a structure, and for each said mobile outrigger scaffold, said clamping mechanism is tightened snugly and said horizontal bracket is mounted on said cylindrical protrusions for each said mobile outrigger scaffold, and when deck planks are placed on said horizontal brackets, said mobile outrigger scaffolds permit movement exterior of a user to the vertical structural member of a structure on said deck planks.

5. A mobile outrigger scaffold using at least two vertical structure members of a structure for floor-by-floor construction and maintenance of a structure without the necessity of ground-up scaffolding, comprising:

a deck support bracket having a horizontal bracket and an angled support bracket said horizontal bracket having a restraint end and a supporting end;

said horizontal bracket having a restraint means at said restraint end to prevent deck planks from sliding over said restraint end;

said angled support bracket attached to said horizontal bracket proximate to said restraint end of said horizontal bracket;

said angled support bracket having a horizontally oriented end parallel to said supporting end of said horizontal bracket;

six rectangular plates having a flat side to be placed against a vertical structural member of a structure, three of said rectangular plates being upper rectangular plates and three of said rectangular plates being lower rectangular plates;

said plates having a vertical plate axis to be parallel to said plate and parallel to a vertical structural member against which said plate is to be placed;

two of said upper plates and two of said lower plates being support plates to be placed a vertical structural member, vertical structural member having corners defining four sides including two faces, said vertical structural member having an exterior face toward the exterior of said structure and an interior face toward the interior of said structure, one of each said upper and lower support plates to be placed adjacent to said interior face, and one each of said upper and lower support plates to be placed adjacent to said exterior face of the same vertical structural member;

said support plates having ends shaped in a C-fold parallel to said vertical plate axis;

said ends shaped in a C-fold having C-folds being sufficiently far apart so that said flat side of said support plates having said ends shaped in C-folds can be placed against a vertical structural member with said C-folds of said ends facing said vertical structural member;

at least one of said ends shaped in a C-fold on each said support having a clamping mechanism exerting pressure interior to said end shaped in a C-fold to pull said other end shaped in a C-fold snugly against said vertical structural member;

said two of said upper support plates and said two of said lower support plates each having at least one cylindrical plate holder protrusion projecting from at least one of said at least one of two ends shaped in a C-fold, said plate holder protrusions being perpendicular to said vertical plate axis, parallel to said flat side and perpendicular to said C-fold, and pointing in correspondent directions when said support plates are disposed on such a vertical structural member;

said third of said upper three plates being an upper bracket plate and said third of said lower three plates being a lower bracket plate;

said bracket plates each having apertures to enable said bracket plates to matingly receive said at least one cylindrical plate holder protrusions retaining each of said bracket plates snugly against each of said two said upper support plates and low support plates when said support plates are placed on opposite faces of a vertical structure member, thereby enabling said bracket plates to be oriented from said interior face to said exterior face of such a vertical structural member;

at least said bracket plates among all of such plates having at least one cylindrical bracket holder protrusion located opposite said flat side of said plate, protruding perpendicularly to said plate, and located on a line perpendicular to said vertical plate axis;

said supporting end of said horizontal bracket having apertures to matingly receive said at least one cylindrical bracket holder protrusion of said upper bracket plate;

said horizontally oriented end of said angled bracket having apertures to matingly receive said at least one cylindrical bracket holder protrusion of said lower bracket plate;

at least one of said at least one cylindrical bracket holder protrusions on each said bracket plate having a securing means to restrain said horizontal bracket and said horizontally oriented bracket onto said protrusion;

at least one of said at least one cylindrical plate holder protrusions on each said support plate having a securing means to restrain said bracket plate;

so that when two of said mobile outrigger scaffolds are received on adjacent structural members of a structure, and for each said mobile outrigger scaffold, said upper and lower support plates are placed one above the other on a structural member of a structure on opposite sides of such a structural member, said clamping mechanisms are tightened snugly, said bracket plates are mounted on said cylindrical plate support protrusions of said support plates, and each said deck support bracket is placed on each set of upper and lower support plates, and when deck planks are placed on said deck support brackets, said mobile outrigger scaffolds permit movement exterior to a vertical structural member of a structure on deck planks set on said deck planks;

and further, so that upon receipt of one of said mobile outrigger scaffolds on a corner structural member of a structure on the outside of such a structural member toward a third vertical structural member around such a corner with said support plate on the side of said corner structural member having similar cylindrical bracket protrusions as said bracket plates, and a third mobile outrigger scaffold having upper and lower support plates having similar cylindrical bracket protrusions as said bracket plates is received on such third vertical structural member around such a corner structural member, and a third deck support bracket is received on said cylindrical protrusions of said bracket plate of said third mobile outrigger scaffold, and a fourth deck support bracket is received on said cylindrical protrusions on said support plate toward said third structural member on the center of said three mobile outrigger scaffolds located around and on the corner of such a structure, upon placing of deck planks on said deck support brackets, said combination of mobile outrigger scaffolds permits movement of a user exterior to the vertical structural members of a structure around the outside of a corner of such a structure on such deck planks set on said deck support brackets.

6. A mobile outrigger scaffold using the vertical structure members for floor-by-floor construction and maintenance of a structure without the necessity of ground-up scaffolding mountable around the corner of a structure using first, second and third vertical structural members including the corner vertical structural member as the second vertical structural member, said vertical members having four corners defining sides, two of which are flat faces, and said faces being parallel, comprising:

at least four deck support brackets each having a horizontal bracket and an angled support bracket;

said horizontal brackets having a restraint end and a supporting end;

each said horizontal bracket having a restraint means at said restraint end to prevent deck planks from sliding over said restraint end;

each said angled support bracket of said deck support bracket being attached to each said horizontal bracket of said same deck support bracket proximate to said restraint end of said each said horizontal bracket;

said angled support bracket of each said deck support bracket having a horizontally oriented end parallel to said supporting end of said horizontal bracket of each said same deck support bracket;

ten rectangular plates having a flat side to be placed against a vertical structural member of a structure, said first and second vertical structural member having exterior faces toward the exterior of said structure and interior faces toward the interior of said structure, and said second and third vertical structural members having an exterior edge toward the exterior of said structure and an interior edge toward the interior of said structure;

five of said rectangular plates being upper rectangular plates and five of said rectangular plates being lower rectangular plates;

said plates having a vertical plate axis to be parallel to said plate and parallel to a vertical structural member against which said plate is to be placed;

two of said upper rectangular plates and two of said lower rectangular plates being support plates to be received on said first vertical structural member, one of each of said upper and lower support plates to be received on said interior face of said first vertical structural member and one of each of said upper and lower support plates to be received on said exterior face of said first structural member;

another two of said upper rectangular plates and two of said lower rectangular plates being support plates to be received on said second vertical structural member, one of each of said upper and lower support plates to be received on said interior face of said second vertical structural member and one of each of said upper and lower support plates to be received on said exterior face of said second vertical structural member;

another one of said upper support plates and another one of said lower plates being support plates to be received on said third vertical structural member, oriented from said interior edge to said exterior edge of such a vertical structural member;

said support plates having ends shaped in a C-fold parallel to said vertical plate axis;

said ends shaped in a C-fold having C-folds being sufficiently far apart so that said flat side of said support plates having said ends shaped in C-folds can be placed against a vertical structural member with said C-folds of said ends facing said vertical structural member;

at least one of said ends shaped in a C-fold on at least one of said support plates on each said vertical structural member having a clamping mechanism exerting pressure interior to said end shaped in a C-fold to pull said other end shaped in a C-fold snugly against each said vertical structural member;

said upper support plates and said lower support plates for at least said first and second vertical structural members each having at least one cylindrical plate holder protrusion projecting from at least one of said at least one of two ends shaped in a C-fold, said plate holder protrusions being perpendicular to said vertical plate axis, parallel to said flat side and perpendicular to said C-fold, and pointing in correspondent directions for each lower and upper support plate when said support plates are received on said vertical structural members;

four rectangular bracket plates having a flat side to be placed toward a vertical structural member of a structure, two of said rectangular bracket plates being upper bracket plates and two of said rectangular bracket plates being lower bracket plates;

said bracket plates each having apertures to enable said bracket plates to be received matingly onto said at least one cylindrical plate holder protrusions retaining said bracket plates against each of said two said upper support plates and lower support plates when said support plates are placed on opposite faces of said first and second vertical structure members, thereby enabling said bracket plates to be oriented from said interior face to said exterior face of said vertical structural members;

at least said bracket plates among all of such plates having at least one cylindrical bracket holder protrusion located opposite said flat side of said plate, protruding perpendicularly to said plate, and located on a line perpendicular to said vertical plate axis;

at least said upper and lower support plates for said interior face of said corner structural member having cylindrical bracket holder protrusions located opposite said flat side of said plate, protruding perpendicularly to said plate, and located on a line perpendicular to said vertical plate axis;

said supporting end of said horizontal bracket having apertures to matingly receive said at least one cylindrical bracket holder protrusion of said upper bracket plate and to accommodate said at least one cylindrical bracket holder protrusion of said upper support plate on said interior face of said corner vertical structural member;

said horizontally oriented end of said angled bracket having apertures to matingly receive said at least one cylindrical bracket holder protrusion of said lower bracket plate and to matingly receive said at least one cylindrical bracket holder protrusion of said lower support plate on said interior face of said corner vertical structural member;

at least one of said at least one cylindrical bracket holder protrusions on each said bracket plate and each said support plate having a securing means to restrain said horizontal bracket and said horizontally oriented bracket onto said protrusion;

at least one of said at least one cylindrical plate holder protrusions on each said support plate having a securing means to restrain said bracket plate;

so that when said upper plates and said lower plates are received on parallel lines on said three adjacent structural members of a structure, said upper support plates and said lower support plates are received one above the other on a structural member of a structure on opposite sides of each said structural member, said clamping mechanisms are tightened snugly, said bracket plates are received on said cylindrical plate support protrusions of said support plates, and said deck support brackets are received on each said upper and lower support plate on each vertical structural member, and when deck planks are received on said deck support brackets, said mobile outrigger scaffolds permit movement of a user exterior to the vertical structural members of a structure on said deck planks set on said deck support brackets;

and further, so that if said three mobile outrigger scaffolds are located around and on the corner of said structure, upon placing of deck planks on said deck support brackets, said combination of mobile outrigger scaffolds permits movement by a user exterior to the vertical structural members of a structure around the outside of a corner of said structure on such deck planks set on said deck support brackets.

7. A mobile outrigger scaffold using at least two vertical structure members of a structure for floor-by-floor construction and maintenance of a structure without the necessity of ground-up scaffolding, said vertical structural members having a depth and width, said structure having an exterior and an interior, and each said vertical structure member having an exterior corresponding to said exterior of said structure, comprising:

a deck support bracket having a horizontal bracket and an angled support bracket;

said horizontal bracket having a restraint end and a supporting end;

said horizontal bracket having a restraint means at said restraint end to prevent deck planks from sliding over said restraint end;

said angled support bracket attached to said horizontal bracket proximate to said restraint end of said horizontal bracket;

said angled support bracket having a horizontally oriented end parallel to said supporting end of said horizontal bracket;

at least one bracket support, being a first bracket support, for each of at least two vertical structure members, said at least one bracket support having a rectangular plate having a flat side to be placed against a vertical structural member of a structure, said rectangular plate having a vertical plate axis to be parallel to said plate and parallel to a vertical structural member against which said plate is to be placed;

said rectangular plate having two ends shaped in at least one 90 degree fold, thus constituting at least an L-fold on each end, said fold being approximately parallel to said vertical plate axis;

at least one of said two ends shaped in at least one 90 degree fold having a clamping mechanism exerting pressure interior to said end shaped in at least one 90 degree fold to pull said other end shaped in at least one 90 degree fold snugly against a vertical structural member;

said ends shaped in at least one 90 degree fold being sufficiently far apart so that said flat side of said rectangular plate between said ends can be placed against a vertical structural member, and further so that one end can also be placed against said same vertical structural member and so that said opposite end with said clamping mechanism exerting pressure interior to said at least one 90 degree fold of said opposite end can be placed against said same vertical structural member;

said at least one bracket support having at least one cylindrical bracket holder protrusion projecting from said rectangular plate opposite said flat side protruding perpendicularly to said plate, and located on a line perpendicular to said vertical plate axis;

said supporting end of said horizontal bracket having apertures to matingly receive said at least one cylindrical bracket holder protrusion of said upper bracket plate when said bracket support is situated on said vertical structural member generally from said interior to said exterior of said structure;

said horizontally oriented end of said angled bracket having apertures to matingly receive a cylindrical bracket holder protrusion from a second bracket support situated below said first bracket support;

at least one of said at least one cylindrical bracket holder protrusions on each said bracket plate having a securing means to restrain said horizontal bracket onto at least one of said cylindrical bracket holder protrusions;

so that when two of said mobile outrigger scaffolds are placed on adjacent structural members of a structure, and for each said mobile outrigger scaffold, said upper and lower bracket supports are placed one above the other on a structural member of a structure, when said clamping mechanisms are tightened snugly, and when each said deck support bracket is placed on sufficient bracket supports to prevent rotation, and when deck planks are placed on said deck support brackets, said mobile outrigger scaffolds permit movement by a user exterior to the vertical structural member of the structure on deck planks;

and further, so that when at least one of said mobile outrigger scaffolds is received on a second corner structural member of a structure on the exterior of such a structural member, and at least one of a second set of bracket supports is located on said corner structural member perpendicular to said at least one of said mobile outrigger scaffolds toward a third vertical structural member, and when each said deck support bracket is placed on sufficient bracket supports on said third vertical structural member to prevent rotation, and when deck planks are placed on said deck support brackets, said mobile outrigger scaffolds permit movement by a user exterior to vertical structural members of the structure on deck planks around said corner.

8. The mobile outrigger scaffold according to claim 7, further comprising:

said at least one bracket support having at least one cylindrical plate holder protrusion projecting from said two ends away from said flat side, said plate holder protrusions being perpendicular to said vertical plate axis, perpendicular to said flat side and pointing in correspondent directions when said support plates are disposed on such a vertical structural member;

and a rectangular safety plate having apertures located on the ends of said safety plate to enable mounting on said at least one cylindrical plate holder protrusion on each end of said bracket support on said cylindrical plate holder protrusions.

9. A mobile outrigger scaffold using at least one horizontal structure member for construction and maintenance of a structure without the necessity of ground-up scaffolding, comprising:

a deck support bracket having a horizontal bracket and an angled support bracket said horizontal bracket having a restraint end and a supporting end;

said horizontal bracket having a restraint means at said restraint end to prevent deck planks from sliding over said restraint end;

said angled support bracket being attached to said horizontal bracket proximate to said restraint end of said horizontal bracket;

said angled support bracket having a horizontally oriented end parallel to said supporting end of said horizontal bracket;

six rectangular plates having a flat side to be planed against a horizontal structural member of a structure;

four of said plates having a vertical plate axis to be parallel to said plate and perpendicular to a horizontal structural member against which said plate is to be placed;

of said four plates, two of said plates being arbitrarily designated left side support plates and two of said plates arbitrarily being designated right side support plates, all four plates being support plates to be received on said horizontal structural member, one of each of said right side support and left side support plates to be received on top of a horizontal structural member and one of each of said right side support and left side support plates to be received beneath a horizontal structural member;

said support plates having ends shaped in a C-fold perpendicular to said vertical plate axis;

said ends shaped in a C-fold being sufficiently far apart so that said flat side of said support plates having said ends shaped in a C-fold can be placed against said horizontal structural member;

at least one of said ends shaped in a C-fold on at least one of said support plates having a clamping mechanism exerting pressure interior to said end shaped in a C-fold to pull said other end shaped in a C-fold snugly against said horizontal structural member;

said two of said left side support plates and said two of said right side support plates each having at least one cylindrical plate holder protrusion projecting from at least one of said at least one of two ends shaped in a C-fold, said plate holder protrusions being perpendicular to said vertical plate axis, parallel to said flat side and perpendicular to said C-fold, and pointing in correspondent directions when said support plates are received on said horizontal structural member;

said remaining two of said six plates being bracket plates;

said bracket plates each having apertures to enable said bracket plates to be received matingly onto said at least one cylindrical plate holder protrusions against each of said two said left side support and right side support plates when said support plates received above and below said structural member;

at least said bracket plates among all of such plates having at least one cylindrical bracket holder protrusion located opposite said flat side of said plate, protruding perpendicularly to said plate, and located on a line perpendicular to said horizontal structural member;

said supporting end of said horizontal bracket having apertures to matingly receive said at least one cylindrical bracket holder protrusion of said bracket plates;

said horizontally oriented end of said angled bracket having apertures to matingly receive said at least one cylindrical bracket holder protrusion of said bracket plates;

at least one of said at least one cylindrical bracket holder protrusions on each said bracket plate having a securing means to restrain said horizontal bracket and said horizontally oriented bracket onto said cylindrical bracket holder protrusion;

at least one of said at least one cylindrical plate holder protrusions on each said support plate having a securing means to restrain said bracket plate;

so that when two of said mobile outrigger scaffolds are placed on structural members of a structure, and for each said mobile outrigger scaffold, said support plates are placed on at least one structural member of a structure, said clamping mechanisms are tightened snugly, said bracket plates are mounted on said cylindrical plate support protrusions of said support plates, and each said horizontal bracket is placed on each said lower support plate, and when deck planks are placed on said horizontal brackets, said mobile outrigger scaffolds permit movement by a user exterior to a vertical structure member of the structure on deck planks set on said deck support brackets;

and further, so that upon mounting of one of said mobile outrigger scaffolds on a corner structural member of a structure on the outside of such a structural member toward a third vertical structural member around such a corner with said support plate on the side of said corner structural member having similar cylindrical bracket protrusions as said bracket plates, and a third mobile outrigger scaffold having upper and lower support plates having similar cylindrical bracket protrusions as said bracket plates is received on said third perpendicular structural member around such a corner structural member, and a third deck support bracket is received on said cylindrical protrusions of said bracket plate of said third mobile outrigger scaffold, and a fourth deck support bracket is received on said cylindrical protrusions on said support plate toward said third structural member on the center of said three mobile outrigger scaffolds located around and on the corner of such a structure, upon placing of deck planks on said deck support brackets, said combination of mobile outrigger scaffolds permits movement by a user exterior to vertical structural members of a structure around the outside of the corner of the structure on such deck planks set on said deck support brackets.

10. A mobile outrigger scaffold using at least two horizontal structural members for floor-by-floor construction and maintenance of a structure without the necessity of ground-up scaffolding, comprising:

a deck support bracket having a horizontal bracket and an angled support bracket said horizontal bracket having a restraint end and a supporting end;

said supporting end being shaped to have a straight end perpendicularly oriented to said horizontal bracket;

said horizontal bracket having a restraint means at said restraint end to prevent deck planks from sliding over said restraint end;

said angled support bracket being attached to said horizontal bracket proximate to said restraint end of said horizontal bracket;

said angled support bracket having a straight end perpendicularly oriented to said supporting end of said horizontal bracket;

six rectangular plates having a flat side to be placed against a horizontal structural member of a structure, three of said rectangular plates being upper rectangular plates and three of said rectangular plates being lower rectangular plates;

four of said plates having a vertical plate axis to be parallel to said plate and parallel to a vertical structural member against which said plate is to be placed;

of said four plates, two of said upper plates and two of said lower plates being support plates to be received on said at least two horizontal structural members, one of each of said upper support plates to be received on top of a first horizontal structural member and one of each of said lower support plates to be received on top of a second horizontal structural member;

said support plates having ends shaped in a C-fold parallel to said vertical plate axis;

said ends shaped in a C-fold being sufficiently far apart so that said flat side of said support plates having said ends shaped in a C-fold can be placed against a horizontal structural member;

at least one of said ends shaped in a C-fold on at least one of said support plates having a clamping mechanism exerting pressure interior to said end shaped in a C-fold to pull said other end shaped in a C-fold snugly against a horizontal structural member;

said two of said upper support plates and said two of said lower support plate each having at least one cylindrical plate holder protrusion projecting from at least one of said at least one of two ends shaped in a C-fold, said plate holder protrusions being perpendicular to said vertical plate axis, parallel to said flat side and perpendicular to said C-fold, and pointing in correspondent directions when said support plates are received on said horizontal structural member;

said third of said upper three plates being an upper bracket plate and said third of said lower three plates being a lower bracket plate;

said bracket plates each having apertures to enable said bracket plates to be received matingly onto said at least one cylindrical plate holder protrusions against each of said two said upper support plates and two said lower support plates when said support plates are placed on said horizontal structure members;

at least said bracket plates among all of such plates having at least one cylindrical bracket holder protrusion located opposite said flat side of said plate, protruding perpendicularly to said plate, and located on a line parallel to said vertical plate axis of said support plates;

said supporting end of said horizontal bracket having apertures to matingly receive said at least one cylindrical bracket holder protrusion of said upper bracket plate;

said horizontally oriented end of said angled bracket having apertures to matingly receive said at least one cylindrical bracket holder protrusion of said lower bracket plate;

at least one of said at least one cylindrical bracket holder protrusions on each said bracket plate having a securing means to restrain said horizontal bracket and said horizontally oriented bracket onto said protrusion;

at least one of said at least one cylindrical plate holder protrusions on each said support plate having a securing means to restrain said bracket plate;

so that when two of said mobile outrigger scaffolds are placed on adjacent structural members of a structure, and for each said mobile outrigger scaffold, said upper and lower support plates are placed on a horizontal structural member of a structure, said clamping mechanisms are tightened snugly, said bracket plates are mounted on said cylindrical plate support protrusions of said support plates, and each said deck support bracket is mounted on each set of support plates, and when deck planks are placed on said horizontal brackets, said mobile outrigger scaffolds permit movement by a user exterior to a horizontal structural member of the structure on deck planks set on said deck support brackets;

and further, so that upon mounting of one of said mobile outrigger scaffolds on a corner structural member of a structure on the outside of such a structural member toward a third structural member around such a corner with said support plate on the side of said corner structural member having similar cylindrical bracket protrusions as said bracket plates, and a third mobile outrigger scaffold having support plates having similar cylindrical bracket protrusions as said bracket plates is mounted on such third vertical structural member around such a corner structural member, and a third deck support bracket is slid on said cylindrical protrusions of said bracket plate of said third mobile outrigger scaffold, and a fourth deck support bracket is slid on said cylindrical protrusions on said support plate toward said third structural member on the center of said three mobile outrigger scaffolds located around and on the corner of such a structure, upon placing of deck planks on said deck support brackets, said combination of mobile outrigger scaffolds permits movement by a user exterior to horizontal structural members of the structure around the outside of a corner of such a structure on such deck planks set on said deck support brackets.

11. A mobile outrigger scaffold using horizontal structure members for floor-by-floor construction and maintenance of a structure without the necessity of ground-up scaffolding, mountable adjacent to and around the corner of said structure, comprising:

a deck support bracket having a horizontal bracket and an angled support bracket said horizontal bracket having a restraint end and a supporting end;

said horizontal bracket having a restraint means at said restraint end to prevent deck planks from sliding over said restraint end;

said angled support bracket attached to said horizontal bracket proximate to said restraint end of said horizontal bracket;

said angled support bracket having a horizontally oriented end parallel to said supporting end of said horizontal bracket;

at least one bracket support, being a first bracket support having a rectangular plate having a flat side to be placed against a horizontal structural member of a structure, said rectangular plate having a horizontal plate axis to be parallel to said plate and parallel to a horizontal structural member against which said plate is to be placed;

said rectangular plate having each end shaped in at least one 90 degree fold, thus constituting at least an L-fold on each end, said fold being approximately parallel to said horizontal plate axis;

at least one of said ends shaped in at least one 90 degree fold having a clamping mechanism exerting pressure interior to said at least one 90 degree fold and pull said other end shaped in at least one 90 degree fold snugly against a horizontal structural member;

said ends shaped in at least one 90 degree fold being sufficiently far apart so that said flat side of said rectangular plate can be placed against a horizontal structural member, so that one end can also be placed against said same horizontal structural member and so that said opposite end with said clamping mechanism exerting pressure interior to said a least one 90 degree fold of said opposite end can be placed against said same horizontal structural member;

said at least one bracket support having at least one cylindrical bracket holder protrusion projecting from said rectangular plate opposite said flat side protruding perpendicularly to said plate, and located on a line parallel to said horizontal plate axis;

said supporting end of said horizontal bracket having apertures to matingly receive said at least one cylindrical bracket holder protrusion of said upper bracket plate when said bracket support is situated on said horizontal structural member generally from inside to the exterior of said structure;

said horizontally oriented end of said angled bracket having apertures to matingly receive a cylindrical bracket holder protrusion from a second bracket support situated below said first bracket support;

at least one of said at least one cylindrical bracket holder protrusions on each said bracket plate having a securing means to restrain said horizontal bracket onto at least one of said cylindrical bracket holder protrusions;

so that when at least two of bracket supports and said brackets are received in adjacent horizontal positions on horizontal structural members of a structure, when said clamping mechanisms are tightened snugly, and when each said bracket support has sufficient cylindrical protrusions to prevent rotation, and when deck planks are placed on said deck support brackets, said mobile outrigger scaffolds permit movement by a user exterior to a horizontal structural member of the structure on said deck planks.

12. The mobile outrigger scaffold according to claim 11, further comprising:

said at least one bracket support having at least one cylindrical plate holder protrusion projecting from said two ends way from said flat side, said plate holder protrusions being parallel to said horizontal plate axis, perpendicular to said flat side and pointing in correspondent directions when said support plates are received on such a horizontal structural member;

and a rectangular safety plate having apertures located on the ends of said safety plate to enable mounting on said at least one cylindrical plate holder protrusion on each end of said bracket support on said cylindrical plate holder protrusions.

13. A mobile outrigger scaffold using the structural members of a structure for floor-by-floor construction and maintenance of a structure without the necessity of ground-up scaffolding, comprising:

at least two deck support brackets having a horizontal component for supporting a deck plank;

each said deck support bracket having at least one restraint to prevent deck planks from sliding over said restraint end;

at least n rectangular deck support plates for each deck support bracket, n being equal to or greater than one, each rectangular plate having m means for retaining said bracket, in being greater than or equal to one, m+n being equal to at least two, said m means for retaining protruding perpendicularly to said plate;

each said rectangular plate having a flat side to be mounted adjacent to a structural member;

said at least one means for retaining said bracket being positioned to maintain said horizontal component for supporting a deck plank in a horizontal position;

said at least one means for retaining said bracket having a first means for securing said bracket;

each said at least two deck support brackets having means for temporarily mounting each said bracket to said means for retaining on each said at least one rectangular plate;

said rectangular plate having a second means for temporarily mounting said plate to a structural member;

said second means for temporarily mounting said plate having at least two folds of at least 90 degrees;

said second means for temporarily mounting said n plates to a structural member having a means for clamping said plate to a structural member;

so that when said deck support plates are received on adjacent vertical structural members of a structure, and said means for clamping said plate to a structural member are tightened snugly, when said deck support brackets are received on said means for retaining, and when deck planks are placed on said deck support brackets, said mobile outrigger scaffold permits movement by a user exterior to a vertical structural member of the structure on said deck planks;

and further, so that when said deck support plates are placed horizontally adjacent on structural members of a structure, and said means for clamping said plate to a structural member are tightened snugly, when said deck support brackets are placed on said means for retaining, and when deck planks are placed on said deck support brackets, said mobile outrigger scaffold permits movement by a user exterior to a vertical structural member of the structure on said deck planks.

14. The mobile outrigger scaffold according to claim 13 for mounting on three adjacent vertical columns, one of which columns is a corner column, further comprising:

at least four deck support brackets;

all rectangular plates being designated as support plates, said at least n rectangular plates on said corner column being designated corner support plates;

said means for temporarily mounting said plate to a structural member having two ends;

said corner support plates each having at least one means for retaining projecting from at least one of said at least one of two ends, said corner support plates having a third means for temporarily mounting said plate, said third means for retaining on each corner support plate being parallel to said flat side and protruding from said end perpendicular to said second means for temporarily mounting, and perpendicular to said first means for temporarily mounting said bracket, and each of said at least one third means for retaining and supporting pointing in a similar direction when said support plates are disposed adjacently on at least one vertical structural member;

another n/2, n/2 being at least one rectangular plates being designated bracket plates and each having at least one, and if n=1, not less than 2, means for retaining said bracket protruding perpendicularly to said plate;

said n/2 rectangular plates having means for mounting to said third means for retaining on said support plates;

at least one means for retaining said bracket having a means for securing said bracket;

so that when at least one set of support plates of said mobile outrigger scaffolds are placed on adjacent vertical structural members of a structure, and said means for clamping said plate to a vertical structural member are tightened snugly, when said deck support brackets are placed on said means for retaining said bracket on said bracket plates, and when deck planks are placed on said horizontal brackets, and when said at least one set of two support plates and a bracket plate is placed on a corner vertical structural member with one support plate and one bracket plate facing the interior of the structures and at least one support plate is placed facing said one support plate facing the interior of the structure on an adjacent vertical structural member, and another set of two support plates and one bracket plate is placed on an adjacent vertical structural member facing said bracket plate, and deck support brackets are placed on said bracket plates and on said facing support plates, and deck planks are placed on said brackets, said mobile outrigger scaffolds permit movement by a user exterior to a vertical structural member of the structure and around a corner of the structure on said deck planks.

* * * * *